US009246287B2

(12) United States Patent
Specht et al.

(10) Patent No.: US 9,246,287 B2
(45) Date of Patent: Jan. 26, 2016

(54) CONNECTING PIECE AND METHOD FOR AFFIXING A CONNECTING PIECE TO ONE END OF A CABLE

(71) Applicants: Klaus Specht, Geisenhausen (DE); Christian Heigl, Niederwinkling (DE); Peter Füssl, Vilsbiburg (DE)

(72) Inventors: Klaus Specht, Geisenhausen (DE); Christian Heigl, Niederwinkling (DE); Peter Füssl, Vilsbiburg (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 147 days.

(21) Appl. No.: 13/962,841

(22) Filed: Aug. 8, 2013

(65) Prior Publication Data

US 2014/0045385 A1 Feb. 13, 2014

(30) Foreign Application Priority Data

Aug. 8, 2012 (DE) ..... 10 2012 214 096

(51) Int. Cl.

| | |
|---|---|
| ***H01R 4/24*** | (2006.01) |
| ***H01R 25/00*** | (2006.01) |
| ***H01R 4/56*** | (2006.01) |
| *H01R 11/09* | (2006.01) |

(52) U.S. Cl.

CPC ..... *H01R 25/003* (2013.01); *H01R 4/56* (2013.01); *H01R 11/09* (2013.01)

(58) Field of Classification Search

CPC ..... H01R 4/5033; H01R 4/5025; H01R 4/58; H01R 13/59; H01R 4/20; H01R 4/2408; H01R 11/26; H01R 11/28; H01R 4/56

USPC ..... 439/427–429, 661

See application file for complete search history.

(56) References Cited

U.S. PATENT DOCUMENTS

| | | | | |
|---|---|---|---|---|
| 3,347,977 | A * | 10/1967 | Scoran et al. | 174/74 R |
| 4,050,773 | A | 9/1977 | Newell | |
| 4,779,067 | A | 10/1988 | Johanson | |
| 6,705,884 | B1 * | 3/2004 | McCarthy | 439/394 |
| 7,121,872 | B1 * | 10/2006 | Hanks | 439/427 |
| 7,121,881 | B2 * | 10/2006 | Jones | 439/578 |
| 7,226,308 | B1 | 6/2007 | Hanks | |
| 7,500,868 | B2 * | 3/2009 | Holland et al. | 439/429 |

FOREIGN PATENT DOCUMENTS

| | | | |
|---|---|---|---|
| DE | 17 95 280 | U | 9/1959 |
| DE | 11 13 973 | | 9/1961 |
| DE | 22 14 527 | B2 | 11/1972 |
| DE | 36 38 253 | A1 | 6/1987 |
| DE | 297 19 000 | U1 | 2/1999 |
| DE | 10 2009 035 995 | A1 | 10/2010 |
| DE | 20 2010 006 671 | U1 | 9/2011 |
| GB | 332 729 | A | 7/1930 |
| GB | 1 388 136 | A | 3/1975 |

OTHER PUBLICATIONS

Search Report, issued by German Patent and Trademark Office, dated Mar. 21, 2013, in German application No. 10 2012 214 096.4 (6 pages).

* cited by examiner

*Primary Examiner* — Xuong Chung Trans

(74) *Attorney, Agent, or Firm* — Finnegan, Henderson, Farabow, Garrett & Dunner LLP

(57) ABSTRACT

A connecting piece for affixing to a cable. The connecting piece comprises a base and a screw connection arranged on the base. The screw connection includes a screw shaped portion, and includes a screw projecting from the base or a hollow with an interior thread.

16 Claims, 9 Drawing Sheets

CONNECTING PIECE AND METHOD FOR AFFIXING A CONNECTING PIECE TO ONE END OF A CABLE

CROSS-REFERENCE TO RELATED APPLICATION

This application is based upon and claims the benefit of priority from German Patent Application No. 10 2012 214 096.4, filed Aug. 8, 2012, the entire contents of which are incorporated herein by reference.

TECHNICAL FIELD

The disclosure relates to a method for affixing a connecting piece to one end of a cable and in particular for connecting two cable ends. The disclosure also relates to a connecting piece for affixing to the end of a cable, and a cable connection comprising such a connecting piece and at least one cable. Methods and apparatuses consistent with the disclosure may be used in a cable harness of a vehicle, in particular a motor vehicle, in the conductor contacts of a motor vehicle or in general in the automobile industry, transport industry, in aviation, mechanical engineering, in the furniture industry, electrical and electronics industry, in consumer electronics, medical technology, etc.

BACKGROUND

DE 36 38 253 A1 discloses a device for connecting two coaxial lines which comprises a sleeve in which connecting pins for contacting the interior conductors are arranged. The sleeve is affixed to the lines via cable boxes and via securing grooves. A connection between the two conductors is established via contact between the connecting pins and the interior conductor.

DE 10 2009 035 995 A1 describes a connecting means which comprises two contact sleeves which respectively surround a cable end. The contact sleeves are pressed together by two tensing sleeves via clamping devices and a clamping body, in order to respectively encompass the cable end. The tensing sleeves are screwed onto the clamping body via a thread, thus connecting the tensing sleeves to the clamping body. The necessity of having to omit the insulation/foam layer in the region of the backlighting has the result that, in that location, the decorative element does not have the haptic properties sought with the insulation/foam layer.

SUMMARY

The present disclosure is based on the object of specifying a method for affixing a connecting piece to one end of a cable, using which the connecting piece can be quickly, reliably and cost-effectively affixed to the cable end. It is also an object of the disclosure to specify a connecting piece for affixing to the facing side and/or end of a cable, wherein the connecting piece is to be able to be quickly, reliably, and cost-effectively affixed to the cable. Another object of the disclosure is to specify a cable connection between at least one cable and a connecting piece, which may be quickly, reliably and cost-effectively established.

The disclosure proceeds on the basis of a connecting piece for affixing to the facing side and/or end of a cable, e.g., an electric cable. The cable, which may be formed as a round cable, may comprise a strand conductor surrounded by an insulation that does not conduct electricity. The strands of the strand conductor may, for example, be straight or stranded. A metal or metal alloy, such as, for example, a copper-based or aluminum-based alloy, may be used as the material for the strand conductor. The cable may also comprise a shielding, e.g., an electrically conductive shielding, which may surround the strand conductor and be, for example, arranged in the insulation of the cable. In some embodiments, the shielding may be electrically separated from the strand conductor. The cable may, for example, be a coaxial cable in which the strand conductor is coaxially surrounded by the shielding. The shielding may be used to shield the strand conductor from electrical and/or magnetic fields, or to protect the environment from the fields emanating from the strand conductor.

The cable may be part of a cable harness for a vehicle, e.g., an aircraft, a watercraft, a ground vehicle, or a motor vehicle. The cable may also be provided for such a cable harness.

The connecting piece, which may be attached to a facing side or end of the cable, may comprise a base and a screw projecting from the base. The base may, for example, be referred to as or embody a housing. The screw at least partially may comprise a screw-shaped portion. That is, the screw may also comprise one or more portions other than the screw-shaped portion, such as, for example, a shaft or shaft portion which may be free of any screw shape. The shaft or shaft portion which may be free of any screw shape may, for example, be arranged between the screw-shaped portion and the base. Alternatively, the screw-shaped portion may be arranged between the shaft and the base. The shaft which may be free of any screw shape may, for example, form the free end of the screw, i.e. the end away from the base. Alternatively, the screw may be completely provided with the screw-shaped portion.

The screw may comprise a shaft or shaft portion, around the circumference of which the screw-shaped portion winds. In other words, the shaft of the screw may be at least partially provided with a thread, or portions of the shaft may be provided with a thread. This thread may be a self-tapping thread or a machine thread. Alternatively, the screw-shaped portion may be wound such that it comprises a cable core, i.e. the region around which the screw-shaped portion is wound may not comprise a shaft. The screw-shaped portion may be wound in the manner of a corkscrew. The screw-shaped portion or the screw may, for example, be formed by a wire, which, for example, may exhibit a circular cross-section and wind in the shape of a screw or helix around, for example, an imaginary cylindrical or conical cable core.

The screw may be made of, for example, a conductive material, such as, for example, metal.

In some embodiments, the connecting piece may comprise at least one integrated plug connector or screw connector, which may be connected in an electrically conductive way to the screw via an integrated electrical conductor and may, for example, be arranged on the base or affixed to the base. The connecting piece may, for example, comprise one, two, three, four, or more plug connectors or screw connectors. A corresponding connecting member may, for example, be plugged onto the plug connector or screwed onto the screw connector. A cable may, for example, be arranged on the connecting member, wherein the conductor of the cable may be connected to the screw via the plug connector or screw connector and in particular via the integrated conductor of the connecting piece. The connecting piece may thus be attached to the end of a cable, wherein the conductor of this cable may be brought into contact in a simple way with the conductor of the cable which may be attached to the plug connector or screw connector. In some embodiments, the at least one plug connector or screw connector may point away from the base, traversing the longitudinal axis of the screw. In other embodiments, such a plug connector or screw connector may point away from the side of the base opposite the side from which the screw projects. The connecting piece which comprises a plurality of plug connectors or screw connectors may also be used as a distributor onto a plurality of conductors which may be plugged or screwed on.

The connecting piece may, for example, comprise an active and/or passive electrical and/or electronic component, e.g., a sensor, a motor, a transmitting and/or receiving element, a control element, or a switching element. An electrical component or said electrical component, which may, for example, comprise or be a fuse and/or an electronic circuit, may be arranged in the electrical conductor between the plug connector or screw connector and the screw and/or threaded portion. The electrical component may for example, fulfill the function of a switch for selectively switching the plug connector or screw connector. The electrical component may be arranged at a distributing point or intersecting point of the integrated conductor.

In some embodiments, the connecting piece may comprise a flange, e.g., an insulating flange or a clamping or latching flange, which may at least be partially arranged around the screw, for example, annularly. The flange may be sub-divided into a plurality of segments over its circumference or may be continuous. The flange may be formed from the same material as the base or from a different material than the base. The flange may be affixed to the base, for example, in a manner that it does not move, or may be formed by the base. The flange may, for example, be moulded onto the base when the base is manufactured. For example, the flange may be injected onto the base by injection-moulding. In some embodiments, there may be a gap between the flange and the screw, forming an annular space between the flange and the screw. The flange may be used to connect the cable for strain relief to the connecting piece and/or to seal off the conductor of the cable, together with the insulation of the cable, from the environment. The flange may, for example, be made from a material that may be connected in a simple way to the insulation of the cable in a material fit.

The flange may, for example, embody a latching flange, which may be latched or connected in a positive fit in general to the cable. The flange may also embody, for example, a cap, which may be affixed, e.g., adhered or crimped, to the cable. The flange may, for example, comprise a plurality of elastic arms distributed over its circumference where the elastic arms may each be provided with at least one engaging element, which may engage with the insulation of the cable and/or with the cap. The insulation or the cap may comprise at least one cavity for receiving the at least one engaging element.

In some embodiments, the flange may have a thread and/or bayonet lock for connecting to the cable, in order to ensure a connection that is preferably releasable but fixed, for example, directly via the conductor and/or the insulation, or indirectly via an intermediate component.

The connecting piece, for example, the base, may comprise an integrated shielding, which shields the integrated conductor of the connecting piece or the base from electrical and/or magnetic inferences. In some embodiments, the shielding may be electrically conductive. The shielding may protrude out of the connecting piece or the base, such that it may be in electrical contact with the optionally provided shielding of the cable to be attached to the connecting piece. For example, the shielding may protrude out of the connecting piece or the base on the side on which the screw projects from the base. The protruding part of the shielding may, for example, penetrate into the insulation of the cable and be in electrical contact with the shielding. The shielding may be exposed at the cable end, such that the part of the shielding of the connecting piece that protrudes out of the connecting piece may be in contact with the exposed part of the shielding of the cable. The shielding may be arranged in the flange or in the region of the flange, thus enabling the shielding of the connecting piece to be in contact with the shielding of the cable.

The base of the connecting piece may be formed from a non-conductive material such as, for example, a thermoset or thermoplastic, which may surround and insulate the conductor integrated into the base. The optionally provided shielding may be arranged in the base and electrically separated from the integrated conductor of the connecting piece.

The connecting piece or the base may, for example, be arranged such that it is rotationally symmetrical about the longitudinal axis of the screw.

In some embodiments, the connecting piece may comprise, in addition to the screw which is also referred to as a first screw, another screw which is referred to as a second screw, wherein the second screw may be substantially like the first screw. The first screw may project from one side, i.e., a first side, of the base. The second screw may project from another side of the base, namely the side opposite the first side. The first screw and the second screw may be affixed to the base. The first screw and the second screw may extend in opposite directions on a common longitudinal axis. This may enable the connecting piece to be used for connecting two cables or two cable ends, i.e., a first cable end and a second cable end. For this purpose, the connecting piece may be affixed between the two cable ends. A cable end may, for example, be affixed to the connecting piece by rotating the screw into the strand conductor. The first cable end may, for example, be affixed to the first screw, and the second cable end may be affixed to the second screw, by respectively rotating the cable relative to the connecting piece. For this purpose, the screw-shaped portion of the first screw may exhibit the same direction of rotation as the screw-shaped portion of the second screw or may exhibit the opposite direction of rotation to the screw-shaped portion of the second screw.

The connecting piece may, for example, be twisted relative to the fixed cable ends, wherein the first screw may be rotated, e.g., screwed, into the first cable end or the first cable, and the second screw may be simultaneously rotated, e.g., screwed, into the second cable end or the second cable. For this purpose, the screw-shaped portion of the first screw may exhibit a direction of rotation that is opposite to the direction of rotation of the screw-shaped portion of the second screw.

The screw-shaped portion of the first screw may, for example, exhibit the direction of rotation of a left-hand thread, while the screw-shaped portion of the second screw may exhibit the direction of rotation of a right-hand thread, or vice versa.

The screw, e.g., the first and/or second screw, may be rotatable or rotationally fixed relative to the base.

The base may be conical, e.g., concavely conical or convexly conical, at the point where the screw projects from the base. The base that is conical at this point may taper in the direction in which the screw projects from the base. This conical portion may, for example, be surrounded by the above-mentioned flange, with or without an annular space. In some embodiments, the conical portion of the base may widen in the direction in which the screw projects from the base.

The disclosure also relates to a method for affixing a connecting piece, e.g., the connecting piece described here, to one end of a cable, wherein the cable comprises a strand conductor and an insulation surrounding the strand conductor. The connecting piece may comprise a base and a screw projecting from the base and at least partially comprising a screw-shaped portion. In accordance with the disclosure, the screw may be rotated, e.g., screwed, into the strand conductor along the longitudinal axis of the cable via the facing side.

A cap may be affixed, e.g., adhered or crimped, to the end of the cable. The cap may be affixed to the insulation of the cable or to the strand conductor. The cap may be formed from a non-conductive material such as, for example, plastic. In some embodiments, the cap may be formed from a conductive material, such as, for example, metal. For example, the cap may include a sleeve, e.g., a metal sleeve coated with an electrically non-conductive material, such as, for example, a plastic or lacquer. The cap may be affixed to the end of the cable before the cable is affixed to the connecting piece. In some embodiments, the cable with the cap affixed to it may be provided for affixing to the connecting piece. The cap may, for example, be fixed and/or secured to the connecting piece via a screw connection, a clamping connection, a plug connection, and/or a bayonet connection. To this end, the connecting piece may, for example, comprise a flange as detailed above, which may engage with a complementary element on the cap. The complementary element could for example embody a groove, a collar, a bolt, and/or a notch.

The screw may be moved through an aperture arranged on the facing side of the cap. For example, the screw may be inserted into the aperture, and rotated into the strand conductor. The portion of the shaft that is free of a screw shape may, for example, be rotated or screwed into the strand conductor, i.e., moved into the strand conductor in a rotational movement combined with a longitudinal movement.

The screw-shaped portion of the screw may be positioned, e.g., anchored, in the aperture of the cap or in the strand conductor to the connecting piece. For example, the screw-shaped portion of the screw may be positioned in the aperture of the cap or in the strand conductor in the position where the cable is affixed, where the cable may be completely affixed. The aperture of the cap may, for example, comprise an interior thread, wherein an exterior thread of the screw-shaped portion engages with this interior thread, thus affixing, i.e. anchoring, the screw-shaped portion to the cap. In such an embodiment, the shaft portion of the screw which is positioned in the strand conductor may be free of a screw shape. The interior thread of the cap may be moulded by rotating the screw in.

In another embodiment, the cap may comprise an aperture in the form of a transit bore that does not comprise a thread, wherein the screw-shaped portion of the screw may be positioned, e.g., affixed or anchored, in the strand conductor when the cable is affixed to the connecting piece.

In embodiments where no cap is provided, the screw-shaped portion may be positioned, e.g., affixed or anchored, in the strand conductor when the connecting piece is affixed to the end of the cable.

In some embodiments, the cable is held spatially fixed, e.g., rotationally fixed, as the connecting piece is affixed to the end of the cable, wherein the connecting piece is rotated relative to the cable.

In embodiments in which the connecting piece comprises a first screw and a second screw, the first cable end and the second cable end may be respectively held spatially fixed, wherein the connecting piece may be rotated relative to the first and second cable, thus rotating the first screw into the strand conductor of the cable via the facing side of the cable and rotating the second screw into the strand conductor of the second cable, e.g., simultaneously. This is enabled, for example, by the opposite directions of rotation of the screw-shaped portion of the first screw and screw-shaped portion of the second screw.

To affix the cable, e.g., the first cable and/or second cable, to the connecting piece, the first cable may be held spatially fixed by a first holding device, and the second cable, where provided, may be held spatially fixed, e.g., rotationally fixed, by a second holding device. The connecting piece may be rotated via a rotating tool, which may include a drive head and/or a drive member, which may, for example, be at least one accommodating chain, a belt, or a rubber rotator, comprising an access, e.g., an open access. The engaging contour of the rotating tool may be adapted to the circumference of the connecting piece or its base. Using the open rotary accommodator, which may be, for example, fork-shaped, the connecting piece may be received, fixed, and rotated up to a defined end point relative to the cable end or ends.

The first and/or second holding device may be moved, e.g., mechanically or freely, along the longitudinal axis of the first and/or second screw. By rotating, e.g., screwing, the screw into the respective cable end, the cable and the holding device may be moved, e.g., drawn, towards the base of the connecting piece due to the rotating screw-shaped portion or are forcibly guided mechanically.

The rotating tool may, for example, be designed such that apparatus or cable connections already connected to the connecting piece may also be received, such that cable connections and as applicable apparatus are already directly available after the connecting process. The cable connections may advantageously be established via the screw connector or plug connector.

The connecting piece may optionally be rotated using electromagnetic pulse technology (EMPT), in that the movement of the connecting piece, which is accelerated in the longitudinal direction within the EMPT magnetic field, may be converted into a rotation by the screws.

In some embodiments, the cable and the connecting piece may be rotated relative to each other in order to rotate the at least one screw in, wherein the flange of the connecting piece may, for example, include an elastic material, which may be deformed and pressed onto the insulation of the strand conductor or onto the cap. This enables the strand conductor to be sealed off from the environment in a simple and cost-effective way. The flange of the connecting piece may, for example, be connected in a material fit, e.g., welded or adhered, to the insulation of the strand conductor or the cap. The material-fit connection enables the strand conductor to be protected from environmental influences. In some embodiments, the material-fit connection enables a water-proof and/or gas-proof connection to be established between the insulation of the cable and the connecting piece or its flange. In another example, the flange of the connecting piece may be pressed onto the insulation of the strand conductor or onto the cap and connected in a material fit, e.g., welded or adhered, to the insulation or the cap by inputting energy, such as, for example, heated air, ultrasound, or the like. This likewise enables a gas-proof and/or water-proof connection to be established between the flange and the insulation of the strand conductor, thus protecting the strand conductor from environmental influences.

In some embodiments, the at least one screw may be rotated or screwed into the strand conductor, and the connecting piece may be additionally fixed to the conductor insulation via the flange in accordance with, e.g., one of the methods described in the preceding paragraphs. This means that the cable may be connected to the connecting piece firmly enough to prevent the cable from detaching from the connecting piece due to, for example, mechanical oscillations. A strain relief may also be provided.

Once it has been screwed into the strand conductor, the at least one screw may be fixed by means of at least one insulating pin, such as, for example, a plastic nail or a plastic rivet, which may be introduced transverse to the longitudinal direction of the cable. This enables the screw to be prevented from being accidentally unscrewed from the strand conductor. In some embodiments, the strand conductor may be compacted after the screw has been rotated in, e.g., by applying a circumferential force that is directed centrally onto the longitudinal axis of the cable.

In another embodiment, the at least one screw and/or the strand conductor may be provided with a plumb, wherein the screw may be connected in a material fit, e.g., soldered, to the strand conductor with the aid of the plumb. This may provide an improved electrical connection between the screw and the strand conductor. In addition, the screw may be secured against rotating out of the strand conductor.

The at least one screw may be connected to the strand conductor in a material fit by means of an electrical current. In some embodiments, an increased current intensity may be applied to the region in which the screw is arranged in the strand conductor, thus connecting the strand conductor to the screw in a material fit, e.g., welding it or soldering it by means of a plumb. This may be achieved by a fusing current via an increased power supply in one of the screw connectors or plug connectors of the connecting piece.

A cable connection in accordance with the disclosure, established, for example, with the aid of the method described here and/or using the connecting piece described here, may comprise a cable and a connecting piece. The cable may comprise a strand conductor and an insulation surrounding the strand conductor. The connecting piece may comprise a base and a screw projecting from the base and at least partially comprising a screw-shaped portion. The connecting piece may be arranged on the facing side of the cable and the screw may be arranged in the strand conductor. The screw-shaped portion may be anchored or arranged in the strand conductor or in the cap affixed to the cable.

In some embodiments, a housing part of a housing, which may be electrically non-conductive, or an electrical conductor that is electrically connected to the strand conductor, may be enclosed, e.g., clamped, between the base of the connecting piece and the cable or the cap.

This enables a feed through the housing to be realised using the cable connection, wherein the housing wall, which may be at least partially flat or plate-shaped, e.g., in the region in which the cable connection is arranged, may, for example, be part of a fuse box or a control apparatus of a motor vehicle or the like. The housing may be formed from an electrically non-conductive material. The base or the flange of the connecting piece may, for example, be pressed against the housing wall and thus form a seal with the housing wall. An annular sealing element or a seal may be arranged between the base and the housing wall. In some embodiments, the insulation of the cable or the cap, which may, for example, be provided with a sealing element or coated with a seal, may be arranged on the other side of the housing wall to the base and, for example, abut the housing wall, forming a seal.

This enables a feed through the housing to be established. Accordingly, the disclosure also relates to a housing comprising such a cable connection.

In the embodiments in which an electrical conductor is arranged or clamped between the base and the cap or the insulation of the cable, the strand conductor may be electrically connected to the electrical conductor, which may, for example, be formed as a flat conductor or flat track. To this end, the flange and/or the cap may be formed from a conductive material that may be connected to the strand conductor.

The conductor ends to be connected may be cut perpendicularly or conically with respect to the longitudinal axis of the conductor.

The advantages of the disclosure may include:

- a technique for quickly connecting conductor ends of any geometry;
- easily establishing branches via integrated plug points in the connecting piece (adaptor);
- a simple connection, given shielded lines, using adapted connecting elements;
- once the cable ends have been connected to the connecting piece; a seal and/or insulation from the outside is ensured;
- highly automatable;
- suitable for quick repair solutions.

BRIEF DESCRIPTION OF THE DRAWINGS

The disclosure has been described on the basis of a number of embodiments which may be combined with each other. The disclosure shah now be described on the basis of figures. The features thus disclosed, individually and in any combination of features, also in particular together with the features of the preceding description, develop the subject-matter of the claims.

DETAILED DESCRIPTION OF THE EMBODIMENTS

Figure 1:
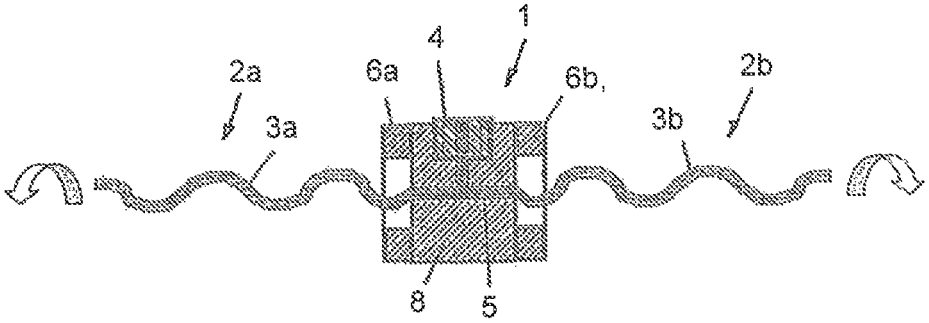
FIG. 1 schematically shows a connecting piece according to an exemplary embodiment.

FIG. 1 shows a connecting piece 1 which comprises a base 8 made of an insulating plastic, e.g., a thermoplastic or thermosetting plastic, into which a plug connector 4 and an electrical conductor 5 are integrated. A first screw 2*a* and a second screw 2*b* project from opposite sides of the base 8 and lie on a common longitudinal axis. The first and second screws 2*a* and 2*b* comprise screw-shaped portions 3*a* and 3*b*, respectively, over their complete length. The screw-shaped portions 3*a* and 3*b* and/or screws 2*a* and 2*b* are formed from helically bent metal wires, which wind around the longitudinal axes of the first and second screws 2*a* and 2*b*, respectively, such that the screw-shaped portions 3*a* and 3*b* each comprise a cable core and is shaped, for example, like a corkscrew. The first screw-shaped portion 3*a* exhibits a direction of rotation which is opposite to that of the second screw-shaped portion 3*b*. The conductor 5, which is integrated into the base 8, connects the plug connector 4, the first screw 2*a*, and the second screw 2*b* in an electrically conductive manner. The plug connector 4 is arranged on the circumferential side of the base 8, i.e. transverse to the longitudinal axis of the first and second screw 2*a*, 2*b*. A first flange 6*a* is arranged on the base 8 and annularly surrounds the first screw 2*a*, wherein an annular space is formed between the screw 2*a* and the flange 6*a*. The same applies similarly to a second flange 6*b* which is likewise arranged on the base 8 and annularly surrounds the second screw 2*b*.

Figure 2:
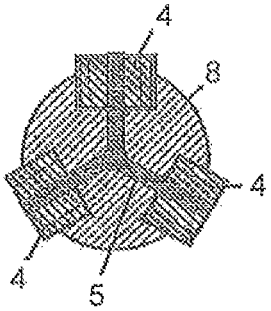
FIGS. 2 and 3 schematically show a connecting piece according to exemplary embodiments.

FIG. 2 shows the base 8 from FIG. 1, wherein it can be seen that a plurality of plug connectors—in this case, three plug connectors 4—are arranged over the circumference of the base 8 and are connected in an electrically conductive manner to the first and second screws 2*a* and 2*b* by the conductor 5. The base 8 is approximately cylindrical in the example shown.

Figure 3:
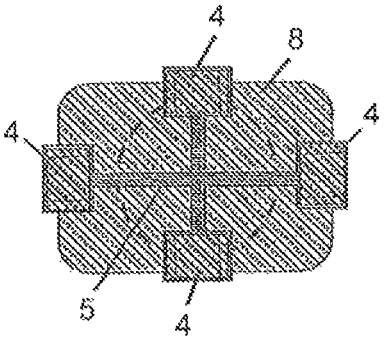

FIG. 3 shows an alternative base 8 which is approximately rectangular with rounded corners in cross-section and comprises a total of four plug connectors 4 which are connected in an electrically conductive manner to the first and second screws 2*a* and 2*b* by the integrated conductor 5. The circle shown by a broken line indicates that at least portions of the base 8 are approximately cylindrical, such as, for example, at least one or two cylindrical portions, in order to form a surface on which a driving device 21 (see for example FIG. 4) may roll off.

Figure 4:
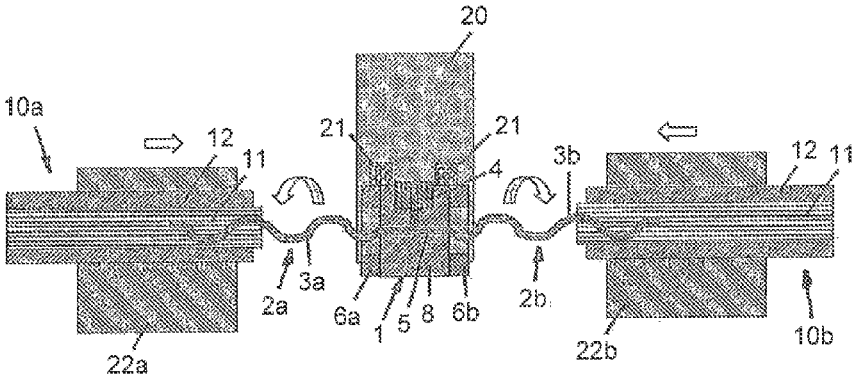
FIG. 4 schematically shows a device according to an exemplary embodiment for connecting cable ends to the connecting piece shown in FIG. 1.

FIG. 4 shows the connecting piece 1 arranged in a rotating tool 20, 21, which comprises a drive head 20 and at least one driving device 21. The driving device 21 shown in FIG. 4 is belt-shaped, for example, in the form of a rubber rotator, a belt, or a rotary chain. The driving device 21 at least partially encompasses the circumference of the connecting piece 1, in particular the base 8, wherein a movement of the driving device 21 in the circumferential direction generates a rotation of the connecting piece 1 relative to a first cable 10*a* and a second cable 10*b*, and relative to the drive head 20. As can be seen from FIG. 4, two driving devices 21 are provided, which are spaced far enough from each other that there is space between them for the plug connector 4, such that the plug connector 4, which protrudes slightly beyond the circumference of the base 8, does not obstruct or at least does not negatively influence the rotation of the connecting piece 1.

A first cable 10*a* is received, rotationally fixed, in a first holding device 22*a*. The second cable 10*b* is received, rotationally fixed, in a second holding device 22*b*. The first and second cables 10*a* and 10*b* may each comprise a strand conductor 11, which is surrounded by an insulation 12. Rotating the connecting piece 1 relative to the first and second cables 10*a* and 10*b* rotates, e.g., screws, the first screw 2*a* into a facing side of the first cable 10*a*, which points towards the connecting piece 1. That is, rotating the connecting piece 1 relative to the first and second cables 10*a* and 10*b* rotates, e.g., screws, the first screw 2*a* into the strand conductor 11. The same applies similarly to the second screw 2*b*, which is screwed into the strand conductor 11 of the second cable 10*b*. While the connecting piece 1 is being rotated, the first holding device 22*a* moves with the first cable 10*a*, and the second holding device 22*b* moves with the second cable 10*b*, towards the base 8. The connecting piece 1 is rotated until the facing side of the first cable 10*a* presses against the first flange 6*a* and elastically deforms it, and the facing side of the second cable 10*b* presses against the second flange 6*b* and elastically deforms it. Since the strand conductor 11 of each of the first and second cables 10*a* and 10*b* protrudes slightly beyond the facing side of the insulation 12 on its facing side pointing towards the connecting piece 1, as can be seen in FIG. 4, the facing side of the strand conductor 11 comes into contact with the base 8, such that the facing side is pressed against the base 8 and thus mushrooms slightly. Since the facing sides of the insulations 12 of the first and second cables 10*a* and 10*b* press against the first flange 6*a* and second flange 6*b*, respectively, and elastically deform them, the strand conductors 11 are sealed off from exterior influences such as, for example, moisture and/or dust.

Figure 5:
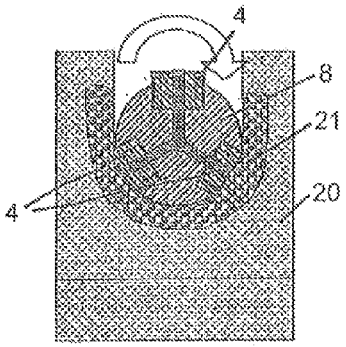
FIG. 5 is an enlarged view schematically showing an exemplary rotating tool of the device shown in FIG. 4.

As can be seen, for example, from FIG. 5, the driving device 21 at least partially encompasses the connecting piece 1 over its circumference.

Figure 6:
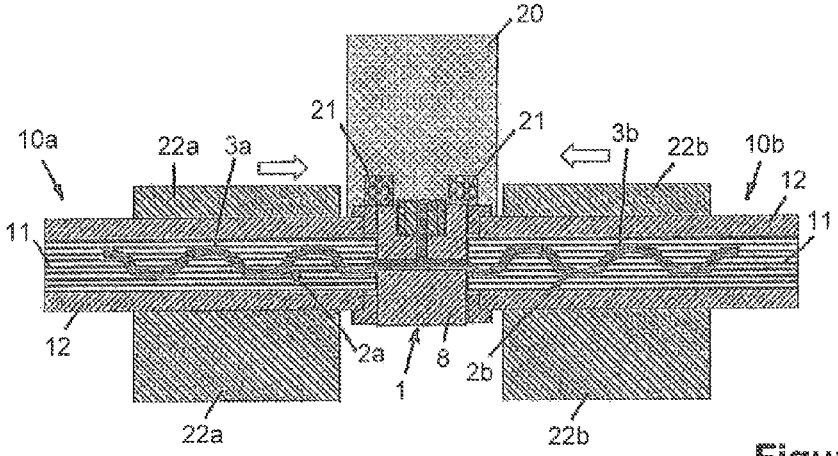
FIG. 6 schematically shows a state of the device in FIG. 4 where screw-shaped portions are screwed into the cable ends.

When the first and second cables 10*a* and 10*b* are in the position shown in FIG. 6 with respect to the connecting piece 1, the insulations 12 of the first and second cables 10*a* and 10*b* may be connected in a material fit, e.g., welded or adhered, to the first flange 6*a* and second flange 6*b*, respectively.

Figure 7:
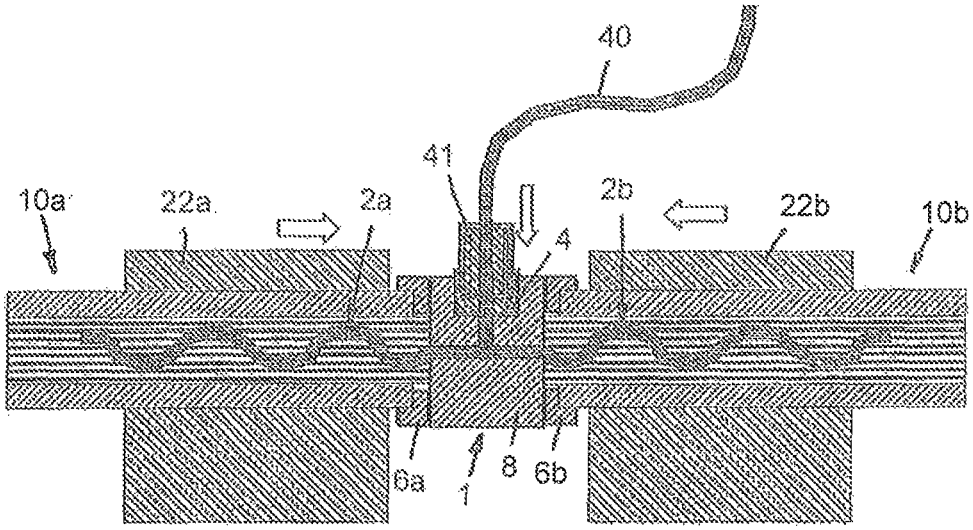
FIG. 7 schematically shows the cable connection of FIG. 6 with a line attached.

As can be seen from FIG. 7, a plug 41, which is arranged on or affixed to a branch cable 40, may be connected to the plug connector 4, which is formed as, for example, a socket, after the rotating tool 20, 21 has been removed, wherein the first and second cables 10*a* and 10*b* are still held by the first and second holding devices 22*a* and 22*b*. This enables the electrical conductor of the branch cable 40 to be electrically connected to the integrated conductor 5 and thus to the strand conductors 11.

Figure 8:
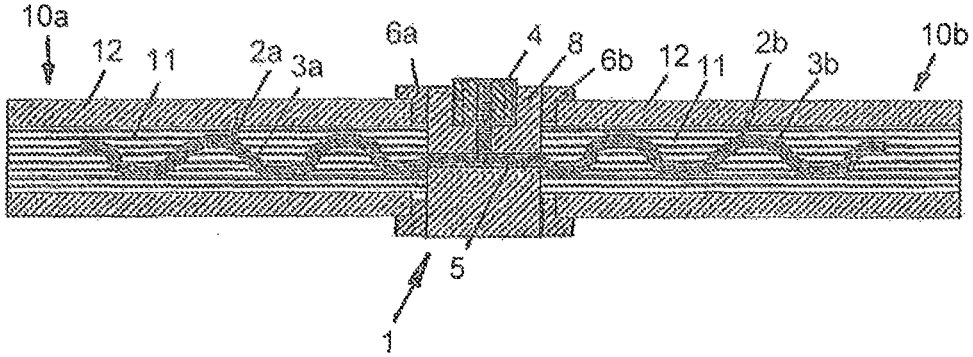
FIG. 8 schematically shows the cable connection of FIG. 7 with no line attached.

FIG. 8 shows a state where the cable connection is removed from the rotating tool and the holding devices 22*a* and 22*b* (FIG. 7). Once the first and second cables 10*a* and 10*b* have been connected to the connecting piece 1, it can be seen that the first screw-shaped portion 3*a* is positioned and anchored in the strand conductor 11 of the first cable 10*a* and that the second screw-shaped portion 3*b* of the second screw 2*b* is positioned and anchored in the strand conductor 11 of the second cable 10*b*. At the same time as this mechanical fixation, the strand conductor 11 of the first cable 10*a* is brought into contact with the first screw 2*a* and the strand conductor 11 of the second cable 10*b* is brought into contact with the second screw 2*b* by rotating the first and second screws 2*a* and 2*b* in.

In some embodiments, the first and second screws 2*a* and 2*b* may be secured in the strand conductor 11 against rotating out by, for example, being welded or soldered. The first flange 6*a* may also be connected in a material fit, e.g., fused, welded, or adhered, to the insulation 12 of the first cable 10*a*, and the second flange 6*b* may also be connected in a material fit, e.g., fused, welded, or adhered, to the insulation 12 of the second cable 10*b*. This may, for example, be achieved by applying an adhesive or by using the rotational energy when the screws 2*a* and 2*b* are rotated into the conductors 11 or by subsequently inputting energy separately.

Figure 9:
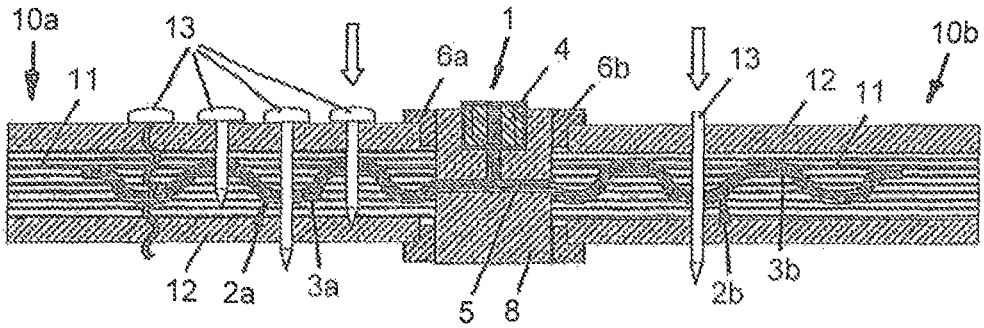
FIG. 9 schematically shows the cable connection of FIGS. 7 and 8 with pins for securing against screws rotating out of the cable end.

Referring to FIG. 9, at least one of the first or second screw 2*a*, 2*b* is secured against rotating out of the strand conductor 11 by means of pins 13, which are introduced into at least one of the cable 10*a* or 10*b* from the outside in the region of the screw 2*a* or 2*b*, transverse to the longitudinal direction of the first or second cable 10*a*, 10*b*. The pins 13 may each, for example, include a straight shaft, which may be pointed at least at one end. The shaft may optionally be provided with a broadened head, for example, at the end opposite the tip, such that the pin 13 may be shaped like a nail or screw, wherein the screw-shaped pin 13 is rotated or screwed in.

The length of the pin 13 may be defined such that the pin 13 extends completely through the cable 10*a* or 10*b* from the outside, such that the tip of the shaft is outside the cable 10*a* or 10*b*. The length of the shaft may be longer than the diameter of the cable 10*a* or 10*b*. Alternatively, the shaft may be shorter than the diameter of the cable 10*a* or 10*b*, such that the tip of the shaft is arranged in the strand conductor 11 or such that the shaft extends through the strand conductor 11 and the tip is arranged in the insulation 12.

The pin 13 may be made of an electrically non-conductive material, such as, for example, plastic, or may be made of an electrically conductive material with or without an insulating coating, such as, for example, a plastic coating. The conductive material may, for example, be metal.

In an optional embodiment (not shown), the tip of the shaft which is arranged outside the cable 10*a* or 10*b* may be deformed such that, for example, a head is formed in a similar manner to a rivet head, which prevents the pin 13 from being removed from the cable 10*a* or 10*b*.

Figure 10:
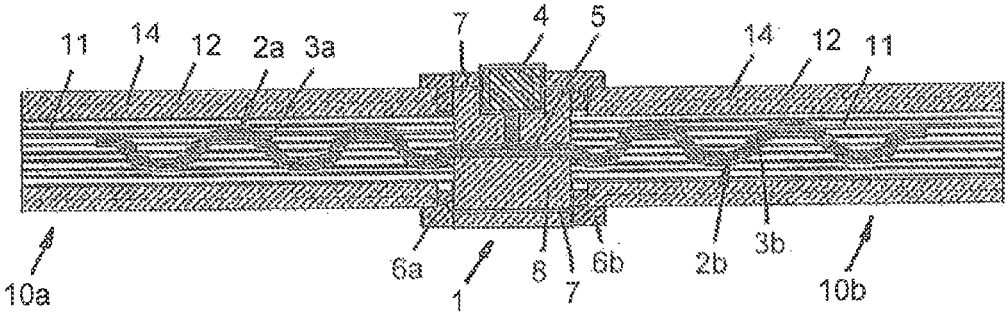
FIG. 10 schematically shows a cable connection according to an exemplary embodiment, with shielding in the cables and in the connecting piece.

FIG. 10 shows a cable connection that is designed in a similar manner to the cable connection shown in FIGS. 1 to 9, and therefore reference is additionally made to FIGS. 1 to 9. The cable connection shown in FIG. 10 additionally comprises a shielding 14 in the first cable 10*a* and a shielding 14 in the second cable 10*b* which are arranged in the insulations 12 and electrically separated from the strand conductors 11. The shielding 14 surrounds the strand conductor 11 concentrically, for example, over substantially the entire length of the cable. The connecting piece 1 also comprises a shielding 7, which is arranged in the base 8 and, for example, in the first and second flanges 6*a* and 6*b* and shields the conductor 5. The shielding 7 is likewise electrically separated from the conductor 5. As can be seen from FIG. 10, the shielding 7 protrudes out of the base 8 such that the shielding 7 is in contact with the shieldings 14 of the first and second cables 10*a* and 10*b*.

Figure 11:
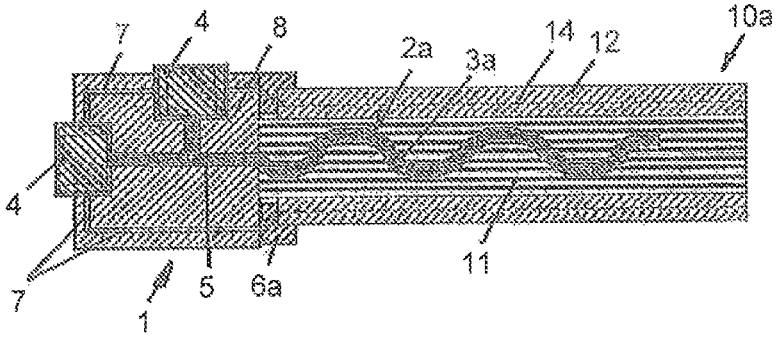
FIG. 11 schematically shows a cable connection according to an exemplary embodiment.

FIG. 11 shows a connection which is designed in a similar way to the cable connection shown in FIGS. 1 to 10, wherein the connecting piece 1 comprises only one screw 2*a*, such that the connecting piece 1 forms an end piece, wherein another branch cable 40 may be connected to the plug connector 4 with the aid of a suitable plug 41. In addition to the plug connector 4, which projects transverse to the longitudinal axis of the screw 2*a*, the connecting piece 1 also comprises a plug connector 4, which is arranged on the side opposite the side from which the screw 2*a* projects. The shielding 7 arranged in the base 8 additionally extends on the facing side.

Figure 12:
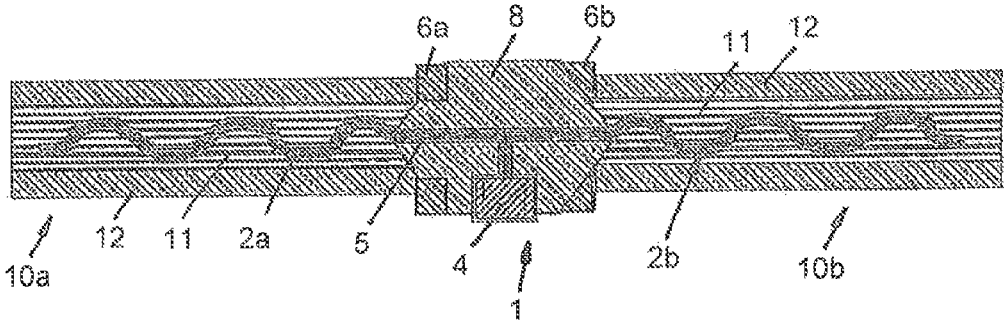
FIG. 12 schematically shows a cable connection according to an exemplary embodiment.

FIG. 12 shows a modification of the cable connection shown in FIGS. 1 to 9, wherein the region in which the screw 2*a* or 2*b* protrudes out of the base 8 is conical and surrounds the screw 2*a* or 2*b*, wherein the cone is formed convexly, i.e. the cone tapers in the direction in which the screw 2*a* or 2*b* projects from the base 8. The advantage of the conical embodiment is that the tapered region of the cone presses into the strand conductor 11, thus enabling an improved electrical contact to be established and/or compacting the strand conductor 11.

As an alternative to a convex cone, a cavity in the form of a concave cone may also be provided, which widens in the projecting direction. This provides the advantage that the strand conductor 11 is compacted towards the longitudinal axis.

FIGS. 13 to 24 show embodiments of a cable connection which have in common that a cap 15 is affixed, e.g., adhered, welded, soldered, or crimped, to the cable end to be connected.

Figure 13:
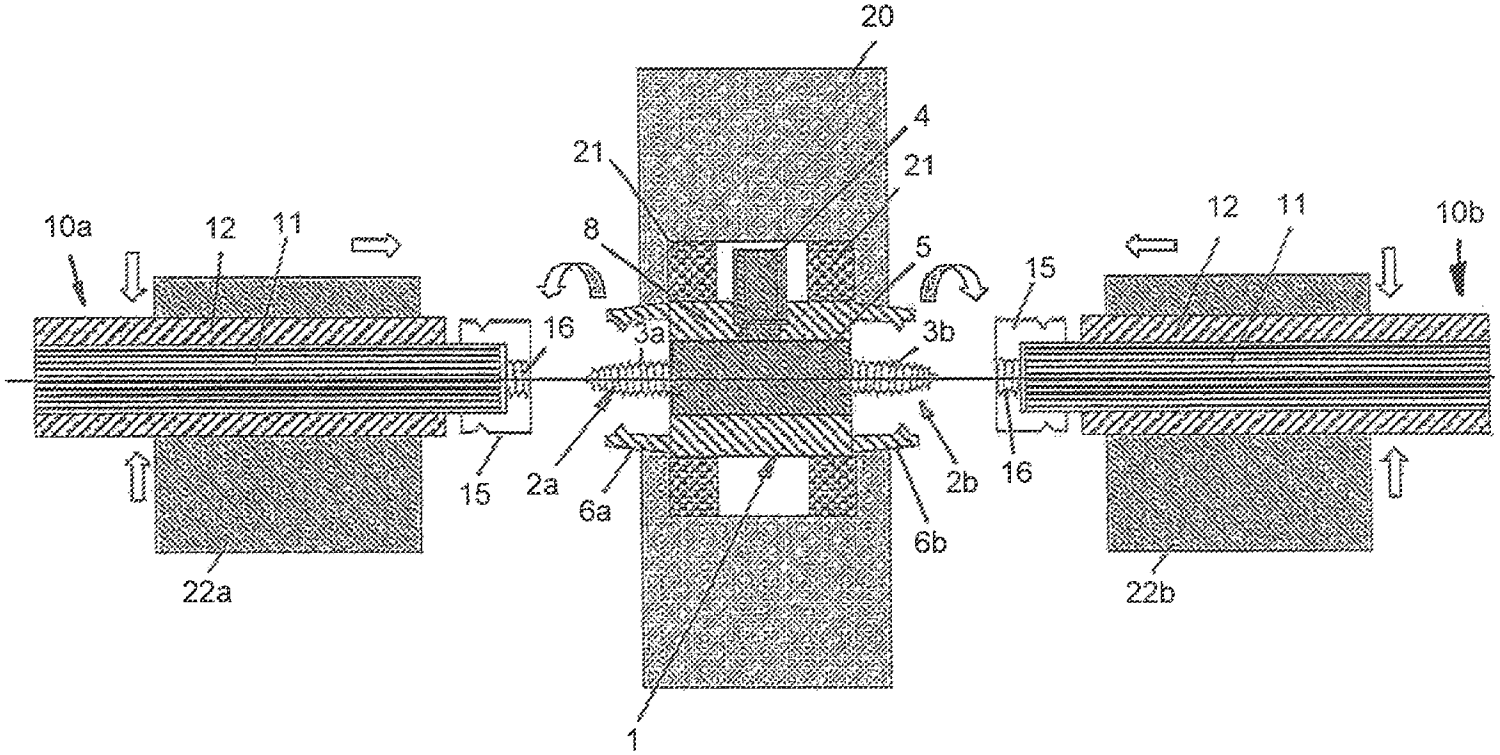
FIG. 13 schematically shows a device according to an exemplary embodiment for connecting cable ends to an alternative connecting piece, and cable ends provided with a cap.

The individual parts of the cable connection shown in FIG. 13 are inserted into the rotating tool described in FIGS. 1 to 7 and the holding devices 22*a* and 22*b*, and reference is additionally made to these figures. With regard to the design of the connecting piece 1 and the cables 10*a* and 10*b* reference is additionally made to the preceding description, in particular the description regarding FIGS. 1 to 12. Identical reference signs denote functionally identical or similar parts.

As can be seen from FIG. 13, the first cable 10*a* and the second cable 10*b* each comprise a cap 15 which is affixed, for example, crimped, to the strand conductor 11. The cap 15 may be formed from a conductive or a non-conductive material. The end of the first or second cable 10*a* or 10*b* to which the cap 15 is affixed is stripped of the insulation 12, such that the cap 15 sits directly on the strand conductor 11 or is affixed to it. The circumferential side of the cap 15 comprises an indentation, e.g., an annular indentation, which may, for example, be produced by crimping. The facing side of the cap 15 comprises a passage 16 which is provided with an interior thread.

The first screw 2*a* and the second screw 2*b* each comprise a shaft, wherein the shafts are completely provided with screw-shaped portions 3*a* and 3*b*, which may also be referred to as threaded portions 3*a* and 3*b*. The shaft tapers towards the free end and at least portions of it between the tapering end and the base 8 are cylindrical. The thread in the cylindrical portion of the shaft may form the complementary thread with respect to the interior thread of the passage 16 in the cap 15. The direction of rotation of the threaded portion 3*a* of the first screw 2*a* is opposite to the direction of rotation of the threaded portion 3*b* of the second screw 2*b*. The direction of rotation of the thread of the passage 16 in the cap 15 for the first cable 10*a* is opposite to the direction of rotation of the thread of the passage 16 in the cap 15 of the second cable 10*b*, i.e. one cap 15 exhibits a left-hand thread and the other cap 15 exhibits a right-hand thread. In some embodiments, it may be expedient, in order to avoid confusion, to mark the cap 15 for the first cable 10*a* and the cap 15 for the second cable 10*b* differently, for example using different colour coding. Corresponding markings may also be arranged on the connecting piece, in order to enable the cap 15 for the first screw (for example left-hand thread to left-hand thread) and the cap 15 for the second screw (right-hand thread to right-hand thread) to be simply and reliably assigned.

As can be seen from FIG. 13, the first cable 10*a* and the second cable 10*b* are each provided with a cap 15 which is affixed to the first or second cable 10*a* or 10*b* before the screws 2*a* and 2*b* are screwed in. That is, the caps 15 are attached to the respective cable ends before the screws 2*a* and 2*b* are screwed in.

The connecting piece 1 is rotated relative to the first and second cables 10*a* and 10*b* by means of the driving device 21 in order to rotate the first screw 2*a* into the strand conductor 11 of the first cable 10*a* and to rotate the second screw 2*b* into the strand conductor 11 of the second cable 10*b*, wherein the screw 2*a* or 2*b* is guided through the passage 16 in the cap 15 and its conical end provided with the thread is rotated into the strand conductor 11, wherein the thread of the cylindrical portion of the shaft of the screw 2*a* enters into engagement with the thread of the passage 16 and is screwed along it.

The connecting piece 1 comprises flanges 6*a* and 6*b* which are formed, for example, elastically, on the base 8 and are provided with a latch which latches to the cap 15, e.g., engages with the indentations arranged on the circumferential side of the cap 15 or engages behind the cap 15, while or at the end of rotating the screw 2*a* or 2*b* into the strand conductor 11.

Figure 14:
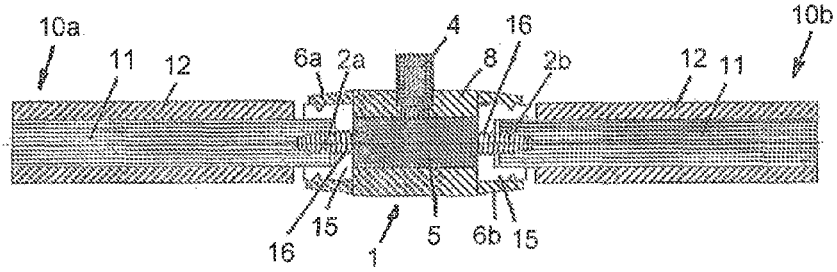
FIG. 14 schematically shows a completed cable connection according to an exemplary embodiment comprising the connecting piece and cables shown in FIG. 13.

FIG. 14 shows the completed cable connection including the parts depicted in FIG. 13, wherein it can be seen that the threaded portion 3*a* or 3*b* of the screw 2*a* or 2*b* is anchored both in the thread of the cap 15 and in the strand conductor 11.

It is noted that a connecting piece 1 designed in accordance with the embodiments shown in FIGS. 13 and 14 may include only one screw 2*a*, for example, along the lines of the embodiment shown in FIG. 11.

Figure 15:
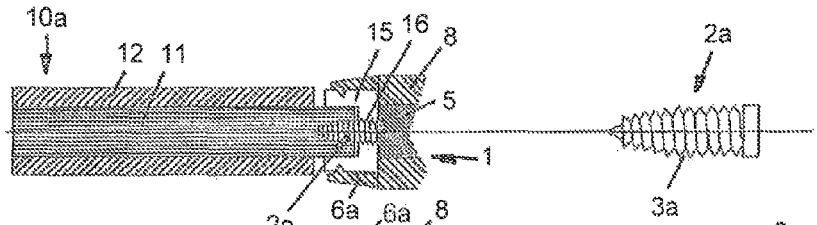
FIG. 15 is an enlarged view of a portion of the cable connection shown in FIG. 14.

FIG. 15 shows in detail the connection between the first cable 10*a* and the first screw 2*a* shown in FIG. 14.

Figure 16:
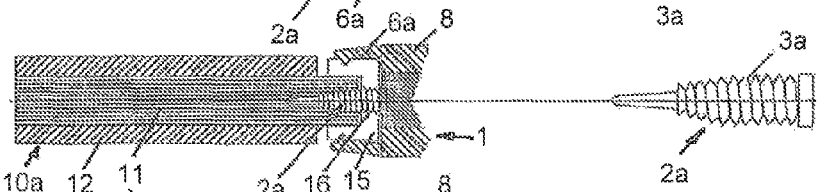
FIG. 16 is an enlarged view schematically showing a screw according to an exemplary embodiment for the cable connection shown in FIGS. 14 and 15.

FIG. 16 shows in detail an alternative screw 2*a* that may be used as the first or second screw 2*a* or 2*b* of the cable connection shown in FIG. 14, wherein the screw 2*a* shown in FIG. 16 comprises a shaft in which the tip is not threaded and which is, for example, formed in the shape of a cone and tapers towards the tip. As shown in FIG. 16, the shaft comprises a cylindrical portion. A conical portion is provided between the cylindrical portion and the non-threaded shaft. The conical portion and the cylindrical portion are provided with a thread and thus form a threaded portion 3*a*. The thread of the cylindrical shaft is used for anchoring in the thread of the cap 15, wherein the thread of the conical shaft is arranged or anchored in the strand conductor 11.

Figure 17:
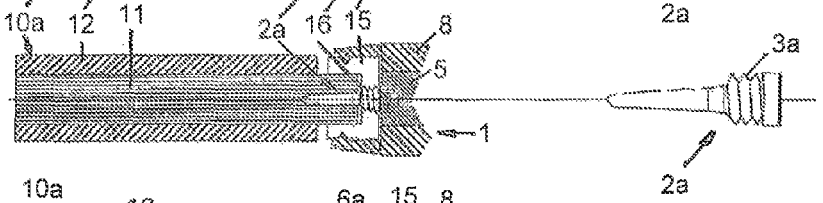
FIG. 17 is an enlarged view schematically showing a screw according to an exemplary embodiment for the cable connection shown in FIGS. 14 and 15.

FIG. 17 shows another alternative screw 2*a* that may be used as the first or second screw 2*a* or 2*b* of the cable connection shown in FIG. 14, wherein the screw 2*a* shown in FIG. 17 comprises a tapered shaft which tapers conically towards the free end and is not threaded. The tapered shaft is connected to a cylindrical shaft, which is provided with the thread-shaped portion 3*a*, i.e., with a thread. The thread from the cylindrical portion is used for screwing into the thread of the passage 16 in the cap 15, wherein the non-threaded portion of the shaft is arranged in the strand conductor 11. The threaded portion 3*a* is thus anchored in the thread of the passage 16 in the cap 15.

Figure 18:
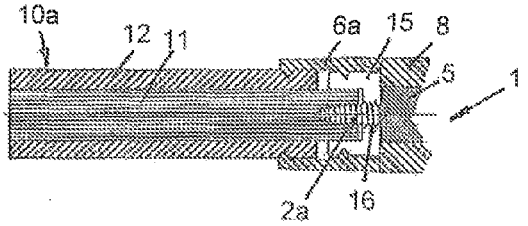
FIG. 18 is an enlarged view schematically showing a flange according to an exemplary embodiment for the cable connection shown in FIGS. 14 and 15.

FIG. 18 shows a flange 6*a* according to an alternative embodiment that may be used as the first or second flange 6*a* or 6*b* for the cable connection shown in FIGS. 13 to 14, which may optionally be modified using the alternative screws 2*a* shown in FIGS. 15 to 17. The flange 6*a* shown in FIG. 18 is formed elastically and has a latch which engages behind the cap 15 or has one latch which engages with the circumferential side of the cap 15 and another latch which engages with the circumference of the insulation 12. The flange 6*a* is thus affixed to both the insulation 12 and the cap 15. Optionally, the flange 6*a* may also be affixed to the insulation 12 only.

Figure 19:
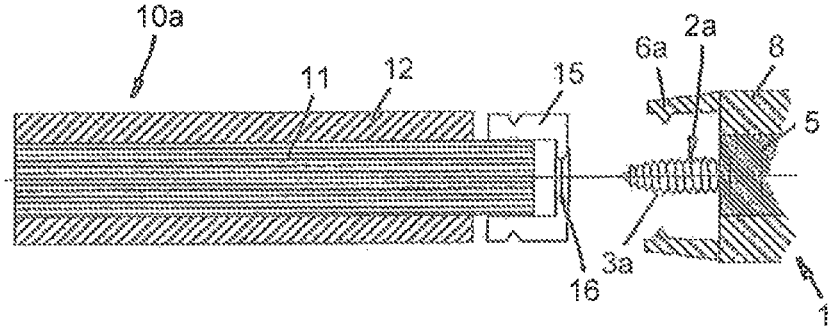
FIGS. 19 and 20 schematically show a cap according to an exemplary embodiment for the cable connection shown in FIGS. 14 and 15.
Figure 20:
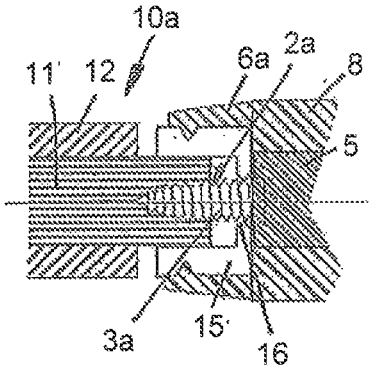

FIGS. 19 and 20 show an alternative embodiment of the cap 15, wherein the passage in the cap 15 exhibits a diameter that is slightly larger than or equal to the diameter of the screw 2*a*, and wherein the screw 2*a* is guided through the passage 16 in the cap 15, and its thread-shaped portion 3*a* is rotated into and anchored in the strand conductor 11. The passage 16 may alternatively be formed such that it exhibits a diameter that is smaller than the diameter of the screw 2*a*, wherein the thread of the screw 2*a* cuts or moulds a thread into the passage in the cap 15.

Figure 21:
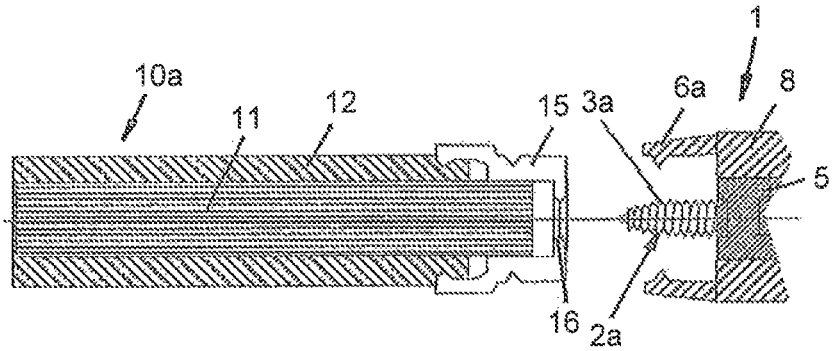
FIGS. 21 and 22 schematically show a cap according to an exemplary embodiment for the cable connection shown in FIGS. 14 and 15.
Figure 22:
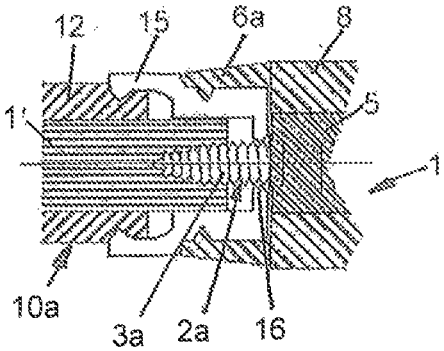

FIGS. 21 and 22 show another alternative embodiment of the cap 15, wherein the cap 15 is affixed, e.g., crimped, to the insulation 12. The cap 15 may alternatively or additionally be affixed, e.g., crimped, to the portion of the strand conductor 11, which protrudes beyond the facing side of the insulation 12. Although FIGS. 21 and 22 show a passage 16 with no thread, the passage 16 may comprise a thread or a thread may be cut or moulded into the passage 16 as the screw 2*a* is screwed into the strand conductor 11. The flange 6*a* of the base 8 then likewise comprises latches which engage with the circumferential side of the cap 15, for example, with an indentation arranged on the circumferential side, which has been formed by, for example, crimping. The screw 2*a* may, for example, exhibit the shape of the screws 2*a* shown in FIGS. 15 to 17.

Figure 23:
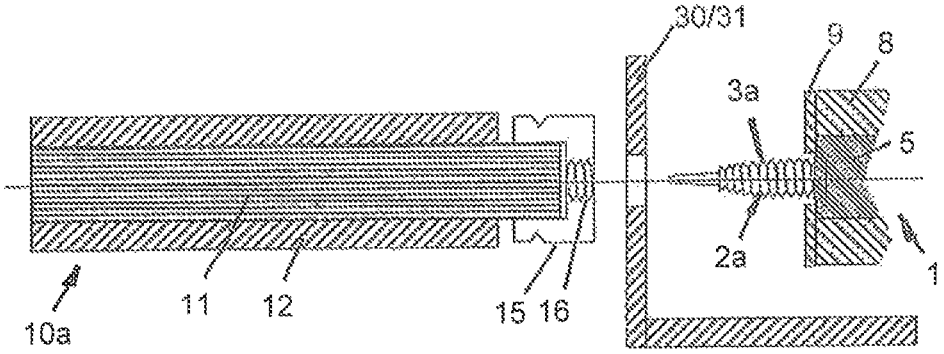
FIG. 23 schematically shows the parts of a cable connection before they are joined together as a feed through a housing or as a fixation on a flat conductor according to an exemplary embodiment.
Figure 24:
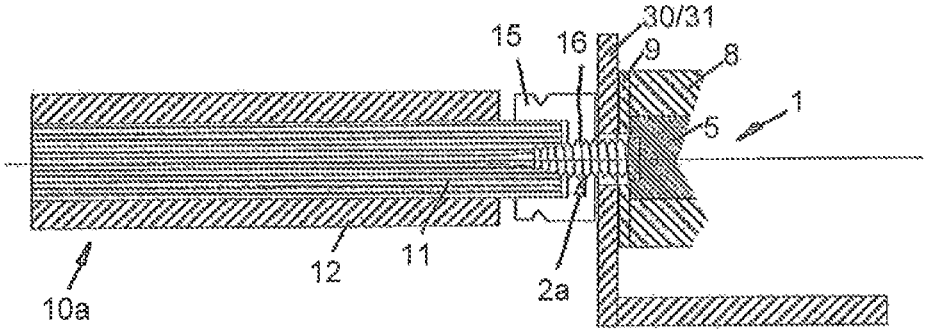
FIG. 24 schematically shows the completed cable connection shown in FIG. 23.

FIGS. 23 and 24 show a feed through a housing, wherein a housing wall 30 is provided with a passage. The housing wall 30 may be plate-shaped, at least in the portion in which the feed through the housing is formed. A cable 10*a* comprising the strand conductor 11, the insulation 12, and a cap 15 affixed to the cable end is provided on one side of the housing wall, e.g., on the exterior side. The connecting piece 1, which is provided with one screw 2*a* only (along the lines of FIG. 11), is provided on the other side of the housing wall 30, e.g., on the interior side. A seal 9 is arranged, surrounding the screw 2*a*, on the side on which the screw 2*a* projects from the base 8. The seal 9 may, for example, be a rubber grommet or a liquid or paste-like seal, which is applied before the screw 2*a* is rotated into the strand conductor 11 and cures or is cured once the screw 2*a* has been rotated into the strand conductor 11. The seal may be or form an adhesive.

In order to rotate the screw 2*a* into the strand conductor 11, the screw 2*a* is guided through the passage in the housing wall 30 and the passage 16 in the cap 15 and rotated into the strand conductor 11 by rotating the screw 2*a* or the connecting piece 1 relative to the cable 10*a*. The housing wall 30 is clamped between the cap 15 and the base 8. The seal 9 prevents, for example, water from penetrating into the housing from the outside. Optionally, the cap 15 may likewise be provided with a seal of the type described here, wherein the seal may be arranged between the housing wall 30 and the cap 15 and annularly surround the passage or the screw 2*a*.

The cap 15 is embodied in accordance with the cap 15 shown in FIGS. 13 and 14. The other caps 15 described in the disclosure may also be suitable for the feed through a housing shown in FIGS. 23 and 24. The screw 2*a* is embodied in accordance with the screw 2*a* shown in FIG. 16. The other screws described in the disclosure may also be suitable for the feed through a housing shown in FIGS. 23 and 24.

The feed through a housing shown in FIGS. 23 and 24 is alternatively also suitable as a feed through a flat conductor, wherein a flat conductor 31 is provided instead of the housing wall 30 and may be brought into contact with the strand conductor 11 in a manner similar to that described above with respect to the housing wall 30. The flat conductor 31 may be plate-shaped, e.g., a metal sheet.

Figure 25:
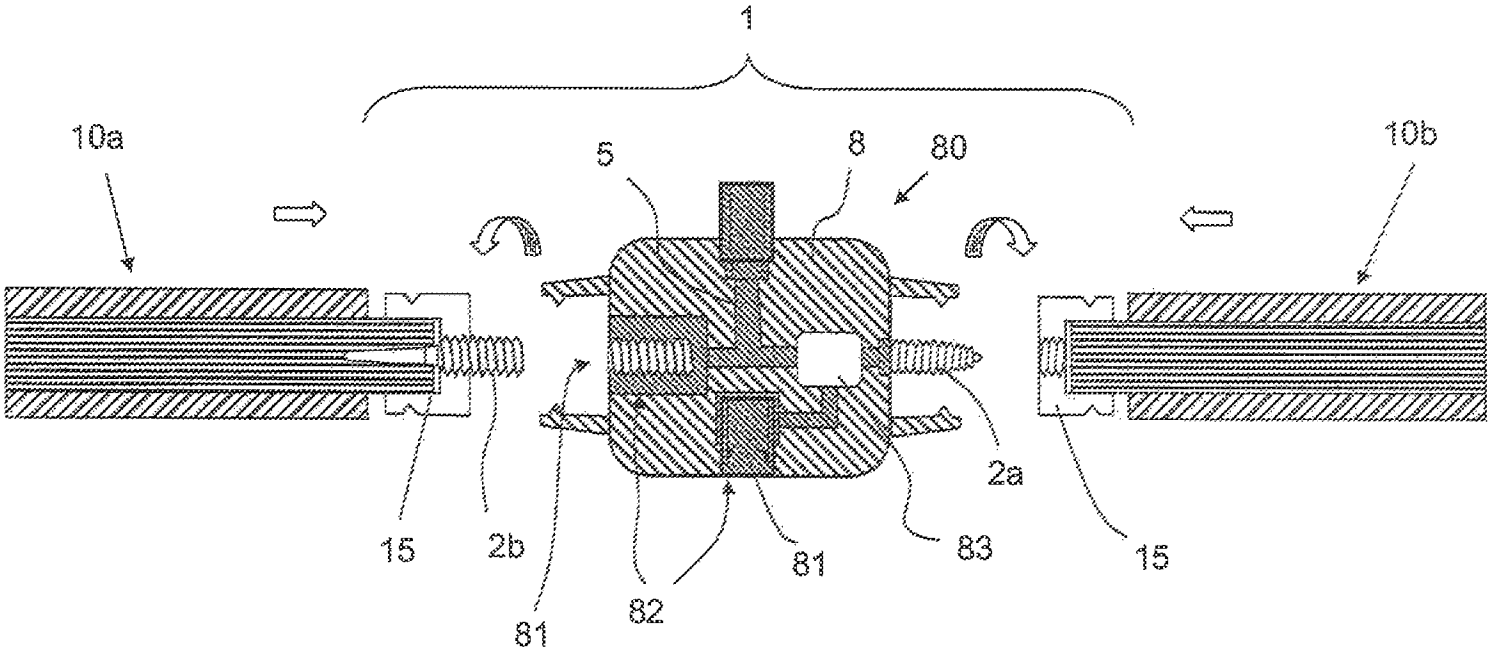
FIG. 25 schematically shows a connecting element according to an exemplary embodiment.

FIG. 25 shows another embodiment of a connecting element 1 in accordance with the disclosure. The connecting element 1 embodies an adaptor element 80 and comprises four connecting portions 82 with screw connections on its base 8 which are respectively arranged in opposite pairs. One screw connection, shown on the left-hand side wall of the base 8, embodies a hollow 81 with an interior thread for receiving a second screw 2*b*, and a screw connection on the right-hand side embodies a first screw 2*a*, for example with an exterior thread, wherein the first screw 2*a* is manufactured integrally with the base 8. Alternatively, the screw connection on the left-hand side may be like the one on the right-hand side, or vice versa. The connecting portions 82 on the upper and lower side of the base 8 are each formed as a plug connection, i.e. as a socket and a plug, respectively. The connecting portions 82 are connected to each other by means of integrated conductors 5, wherein the integrated conductor 5 to the lower connecting portion 82 comprises an electrical component 83, for example, a fuse. Alternatively and/or additionally, the electrical component 83 may, among other things, embody an electronic circuit, comprise the function of a switch for selectively switching the connecting portions 82 and correspondingly be arranged at a distributing point and/or intersection point of the integrated conductor 5. Such an electrical component 83 may also be connected up to the electrical conductor 5 in the other embodiments described in the disclosure, e.g., between a plug 4, which may also be referred to in general as a connecting portion, and the screw 2*a* or 2*b*.

In order to connect the connecting element 1 to a strand conductor 11 of the first cable 10*a*, a cap 15, which is screwed onto the first cable 10*a* by the second screw 2*b* into the strand conductor 11, is connected to the connecting element 1 via the left-hand connecting portion 82. Another cap 15 is also affixed to a strand conductor 11 of the second cable 10*b*. A first screw 2*a*, which is arranged on the connecting element on the right-hand side, additionally establishes an electrical connection between the other cap 15 and the strand conductor 11 of the second cable 10*b*.

Both the first screw 2*a* and the second screw 2*b* have a different direction of rotation, such that a rotational movement of the connecting element 1 simultaneously affixes the first and second cable 10*a*, 10*b* and thus simultaneously brings the two strand conductors 11 into contact with the connecting element 1.

LIST OF REFERENCE SIGNS

1 connecting piece
2*a*, 2*b* first/second screw
3*a*, 3*b* first/second screw-shaped portion
4 plug connector or screw connector
5 conductor
6*a*, 6*b* first/second flange
7 shielding
8 base
9 seal
10*a*, 10*b* first/second cable
11 strand conductor
12 insulation
13 pin
14 shielding
15 cap
16 aperture
20 drive head
21 drive device
22*a*, 22*b* holding device
30 housing wall
31 flat conductor
40 branch cable
41 plug
80 adaptor element
81 hollow
82 connecting portion
83 electrical/electronic component

What is claimed is:

1. A cable connection configured to connect to a cable including a strand conductor and an insulation at least partially surrounding the strand conductor, the cable connection comprising:
- a cap affixed to the cable;
- a connecting piece affixed to the cable, the connecting piece including:
  - a base;
  - a screw arranged on and projecting from the base, the screw including a screw-shaped portion, and
  - a flange arranged around the screw,
- wherein:
  - the screw is arranged in the strand conductor,
  - the screw-shaped portion is anchored in at least one of the strand conductor or the cap, and
  - the flange is connected to the cap, and includes a latching flange latched to the cap.

2. The cable connection according to claim 1, wherein:
- the screw is a first screw,
- the connecting piece further includes a screw connection having:
  - a second screw projecting from the base; or
  - a hollow with an interior thread,
- the first screw is arranged on a first side of the base, and
- the second screw is arranged on a second side of the base different from the side.

3. The cable connection according to claim 2, wherein the first side and the second side are opposite to each other.

4. The cable connection according to claim 2, wherein:
- the screw-shaped portion is a first screw-shaped portion,
- the second screw includes a second screw-shaped portion, and
- a direction of rotation of the first screw-shaped portion is opposite to a direction of rotation of the second screw-shaped portion.

5. The cable connection according to claim 1, wherein the screw-shaped portion is helically wound.

6. The cable connection according to claim 1, further comprising:
- an integrated conductor electrically coupled to the screw; and
- an integrated connector electrically coupled to the integrated conductor.

7. The cable connection according to claim 6, wherein the integrated connector includes one of an integrated plug connector or an integrated screw connector.

8. The cable connection according to claim 6, further comprising:

an integrated electrically conductive shielding surrounding the integrated conductor.

9. The cable connection according to claim 1, further comprising:

a first connecting portion for connecting to an electrical line, the first connecting portion including a hollow having:

an interior thread; and a plug portion for receiving the screw; and a second connecting portion for connecting to the electrical line.

10. The cable connection according to claim 9, wherein the first and second connecting portions are electrically coupled to each other.

11. The cable connection according to claim 1, further comprising:

an active or passive electrical or electronic component.

12. The cable connection according to claim 11, wherein the electrical or electronic component includes one of a sensor, a motor, a transmitting element, a receiving element, a transceiving element, a control element, or a switching element.

13. The cable connection according to claim 1, wherein the cap is affixed to at least one of the strand conductor or the insulation.

14. The cable connection according to claim 1, further comprising:

a housing or an electrical conductor electrically coupled to the strand conductor, wherein a housing part of the housing or the electrical conductor is enclosed between the base and the cable.

15. The cable connection according to claim 1, wherein the flange is connected to the cap or the insulation in a material fit.

16. The cable connection according to claim 15, wherein the material fit includes at least one of a welded joint or an adhesive joint.

* * * * *